US007507918B2

(12) United States Patent
Kazama

(10) Patent No.: US 7,507,918 B2
(45) Date of Patent: Mar. 24, 2009

(54) MULTIDIRECTIONAL INPUT APPARATUS AND ELECTRONIC DEVICE

(75) Inventor: Yoshihiro Kazama, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 12/036,699

(22) Filed: Feb. 25, 2008

(65) Prior Publication Data

US 2008/0237023 A1 Oct. 2, 2008

(30) Foreign Application Priority Data

Mar. 30, 2007 (JP) ..... 2007-094431

(51) Int. Cl.
*H01H 9/00* (2006.01)

(52) U.S. Cl. ..... 200/6 A; 200/5 R; 345/157; 74/471 XY

(58) Field of Classification Search ..... 200/5 R, 200/5 A, 6 A, 17 R, 18, 329, 339; 345/157, 345/161; 74/471 XY, 471 R
See application file for complete search history.

(56) References Cited

U.S. PATENT DOCUMENTS 5,396,030 A * 3/1995 Matsumiya et al. ..... 200/6 A
6,225,579 B1 * 5/2001 Ritter et al. ..... 200/6 A
6,809,274 B2 * 10/2004 Takeuchi et al. ..... 200/6 A
6,963,039 B1 * 11/2005 Weng et al. ..... 200/302.1
7,123,240 B2 * 10/2006 Kemppinen ..... 345/161

* cited by examiner

*Primary Examiner*—Kyung Lee
(74) *Attorney, Agent, or Firm*—Oblon, Spivak, McClelland, Maier & Neustadt, P.C.

(57) ABSTRACT

Provided is a multidirectional input apparatus. The multidirectional input apparatus includes a pressing operation member including a surface, a first pressing portion and a second pressing portion provided on a first axis on the surface, and a third pressing portion and a fourth pressing portion provided on a second axis which passes between the first pressing portion and the second pressing portion and is perpendicular to the first axis on the surface, a first tilting member connected to the pressing operation member on a pressing direction side and capable of tilting from a first neutral position by a pressing force to the third pressing portion and the fourth pressing portion with two points on a third axis in parallel to the first axis being a first supporting point and a second supporting point, respectively, and a second tilting member connected to the first tilting member on the pressing direction side and capable of tilting from a second neutral position by a pressing force to the first pressing portion and the second pressing portion with two points on a fourth axis in parallel to the second axis being a third supporting point and a fourth supporting point, respectively.

7 Claims, 12 Drawing Sheets

MULTIDIRECTIONAL INPUT APPARATUS AND ELECTRONIC DEVICE

CROSS REFERENCES TO RELATED APPLICATIONS

The present invention contains subject matter related to Japanese Patent Application JP 2007-094431 filed in the Japanese Patent Office on Mar. 30, 2007, the entire contents of which being incorporated herein by reference.

BACKGROUND OF THE INVENTION

1. Field of the Invention

The present invention relates to a multidirectional input apparatus provided to an electronic device such as AV (audio-visual) equipment or a game machine, and an electronic device equipped with the multidirectional input apparatus.

2. Description of the Related Art

In related art, a so-called arrow key includes pressing operation portions on the left, right, top, and bottom thereof. The arrow key has a supporting point at a center thereof and tilts with respect to the supporting point in response to pressing operations in the four directions. For example, in a multidirectional input apparatus described in Japanese Patent Application Laid-Open No. 2003-151409, FIGS. 1 to 3, a key top has a cross-shaped groove dividing the key top into quarters and has a stick-shaped convex portion projecting to a base material side from a bottom surface of a crossover point of the cross-shaped groove. This structure allows the key top to pivot about the convex portion.

SUMMARY OF THE INVENTION

However, when the key top is caused to pivot about the single supporting point as described in Japanese Patent Application Laid-Open No. 2003-151409, FIGS. 1 to 3, the key top is not stable. Therefore, a tilting angle of the key top or a tilting stroke against a pressing operation varies. To correct the variations, a buffer such as a coil spring or a urethane cushion may be provided. But the buffer may lessen the pressing force, which causes poor operability. In particular, a wide range of variations may be caused as the size of the multidirectional input apparatus is increased, which significantly degrades operability. In addition, providing the buffer increases the number of parts. As a result, variations in manufacturing may be often caused, which may reduce a yield.

In view of the above, it is desirable to provide a multidirectional input apparatus capable of stably tilting in response to the pressing operation to upgrade operability, and an electronic device equipped with the multidirectional input apparatus.

According to an embodiment of the present invention, there is provided a multidirectional input apparatus. The multidirectional input apparatus includes a pressing operation member, a first tilting member, and a second tilting member. The pressing operation member includes a surface, a first pressing portion and a second pressing portion which are provided on a first axis on the surface, and a third pressing portion and a fourth pressing portion which are provided on a second axis which passes between the first pressing portion and the second pressing portion and is perpendicular to the first axis on the surface. The first tilting member is connected to the pressing operation member on a pressing direction side and is capable of tilting from a first neutral position by a pressing force to the third pressing portion and the fourth pressing portion with two points on a third axis in parallel to the first axis being a first supporting point and a second supporting point, respectively. The second tilting member is connected to the first tilting member on the pressing direction side and is capable of tilting from a second neutral position by a pressing force to the first pressing portion and the second pressing portion with two points on a fourth axis in parallel to the second axis being a third supporting point and a fourth supporting point, respectively.

Herein, the multidirectional input apparatus refers to a so-called arrow key allowing a pressing operation from side to side and up and down. The first and second pressing portions serve as up and down (right and left) keys, while the third and fourth pressing portions serve as right and left (up and down) keys, for example.

With this structure, the second tilting member tilting through the pressing operation to the first and second pressing portions and the first tilting member tilting through the pressing operation to the third and the fourth pressing portions are separately provided. Further, the first and second tilting members are configured to have two supporting points, respectively. As a result, the first and second tilting members tilt while being stably supported by the two supporting points. Thus, variations in a tilting angle and a tilting stroke in response to the pressing operations can be eliminated, with the result that operability at the time of the pressing operation can be remarkably enhanced.

The multidirectional input apparatus may further includes a supporting member supporting the second tilting member. In the multidirectional input apparatus, the first tilting member may include a first base portion connected to the pressing operation member, and a first connection portion and a second connection portion which are integrally provided on both ends of the first base portion on the third axis, and connected to the second tilting member so as to be the first supporting point and the second supporting point, respectively. The second tilting member may include a second base portion including a third connection portion and a fourth connection portion which are connected to the first connection portion and the second connection portion, respectively, on an axis perpendicular to the fourth axis, and a fifth connection portion and a sixth connection portion which are integrally provided on both ends of the second base portion on the fourth axis, and connected to the supporting member so as to be the third supporting point and the fourth supporting point, respectively.

With this structure, the first tilting member and the second tilting member are positively connected to each other through the first and second connection portions of the first tilting member and the third and fourth connection portions of the second tilting member. Further, the second tilting member and the supporting member are positively connected to each other through the fifth and sixth connection portions of the second tilting member. Therefore, even when the first tilting member and the second tilting member are separately provided for the pressing operations to the first and second pressing portions and to the third and fourth pressing portions, respectively, a stable tilting operation and pressing operation can be performed. Further, the first and second connection portions and the fifth and sixth connection portions are integrally provided with the first base portion and the second base portion, respectively. Therefore, there is no need to provide an additional part to connect the connection portions and the base portions. That is, an increase in number of parts can be prevented.

In the multidirectional input apparatus, the first tilting member may have a first return spring force to return to the first neutral position against the pressing force to the third pressing portion and the fourth pressing portion. The second tilting member may have a second return spring force to return to the second neutral position against the pressing force to the first pressing portion and the second pressing portion.

With this structure, each of the first and second tilting members has the return spring force. Therefore, stable, comfortable pressing operability (tactile feedback when the pressing operation is performed) can be given to a user without increasing the number of parts, as compared with a case where a buffer material for return such as a coil spring or a urethane cushion is additionally provided. As a result, the variation in manufacturing can be suppressed and a yield can be increased.

In the multidirectional input apparatus, one of a set of the first and second connection portions and a set of the third and fourth connection portions may be made of a flexible material capable of using a first twisting force accumulated due to the pressing force to the third pressing portion and the fourth pressing portion as the first return spring force. The fifth and sixth connection portion may be made of a flexible material capable of using a second twisting force accumulated due to the pressing force to the first pressing portion and the second pressing portion as the second return spring force.

With this structure, the first and second connection portions or the third and fourth connection portions are made of a material capable of accumulating the first return spring force generated by being twisted in a predetermined direction through the pressing operation to the third and fourth pressing portions. Meanwhile, the fifth and sixth connection portions are made of a material capable of accumulating the second return spring force generated by being twisted in a predetermined direction through the pressing operation to the first and second pressing portions. Therefore, a comfortable pressing operability can be obtained with a simple structure, without providing a particular mechanism to cause the tilt.

The multidirectional input apparatus can be provided to an electronic device. The electronic device includes a casing including a first surface in parallel to the surface, a second surface which is an inner surface of the first surface, and an opening causing the first surface and the second surface to be communicated with each other and causing the pressing operation member to be exposed. The first and third connection portions and the second and fourth connection portions may constitute a hinge mechanism capable of tilting the first tilting member by rotation about the third axis. The first base portion may be contactable to the second surface along with pressing to the third pressing portion and the fourth pressing portion, and integrally include a first biasing portion and a second biasing portion capable of using, as the first return spring force, biasing forces against contacting forces when the hinge mechanism is rotated. The fifth and sixth connection portions may be made of a flexible material capable of using a twisting force accumulated due to the pressing force to the first pressing portion and the second pressing portion as the second return spring force.

With this structure, the first and second connection portions of the first tilting member are structured to have the hinge mechanism. As a result, the width of the multidirectional input apparatus in the third axis direction is reduced to save the size thereof. At the same time, the first and second biasing portions are brought into contact with the second surface to thereby produce the first return spring force. In addition, the fifth and sixth connection portions of the second tilting member are made of a material capable of accumulating the twisting force as the second return spring force, which can produce comfortable pressing operability without providing the particular mechanism to cause the tilt. Note that the supporting member may be a part of the casing.

In the multidirectional input apparatus, the pressing operation member may include a first opening portion formed at a center of the surface so as to be surrounded by the first to fourth pressing portions. The first tilting member may include a second opening portion formed between the first supporting point and the second supporting point. The second tilting member may include a third opening portion formed between the third supporting point and the fourth supporting point. The multidirectional input apparatus may further include a fifth pressing portion provided so as to be exposed from the surface and pass through the first to third opening portions.

With this structure, an axis with respect to which the tilting member tilts is not provided at the center of the pressing operation member. Therefore, only by providing the first to third opening portions, the fifth pressing portion can easily be provided at the center of the pressing operation member without interfering with any other member, and convenience can be improved.

According to another embodiment of the present invention, there is provided an electronic device. The electronic device includes a multidirectional input apparatus, a casing, and first to fourth switches. The multidirectional input apparatus includes a pressing operation member, a first tilting member, and a second tilting member. The pressing operation member includes a surface, a first pressing portion and a second pressing portion which are provided on a first axis on the surface, and a third pressing portion and a fourth pressing portion which are provided on a second axis which passes between the first pressing portion and the second pressing portion and is perpendicular to the first axis on the surface. The first tilting member is connected to the pressing operation member on a pressing direction side and is capable of tilting from a first neutral position by a pressing force to the third pressing portion and the fourth pressing portion with two points on a third axis in parallel to the first axis being a first supporting point and a second supporting point, respectively. The second tilting member is connected to the first tilting member on the pressing direction side and is capable of tilting from a second neutral position by a pressing force to the first pressing portion and the second pressing portion with two points on a fourth axis in parallel to the second axis being a third supporting point and a fourth supporting point, respectively.

Herein, the "electronic device" refers to electronic devices such as audiovisual equipment, a game machine (including a controller for a game machine), a PC (personal computer), and a car navigation system, and any other electronic devices involving an operating portion, such as a remote control for various electronic devices.

As described above, according to the present invention, by performing the stable tilt in response to the pressing operation, the operability can be enhanced.

These and other objects, features and advantages of the present invention will become more apparent in light of the following detailed description of best mode embodiments thereof, as illustrated in the accompanying drawings.

DESCRIPTION OF PREFERRED EMBODIMENTS

Next, with reference to the accompanying drawings, embodiments of the present invention will be described.

First Embodiment

First, a first embodiment of the present invention will be described.

Figure 1:
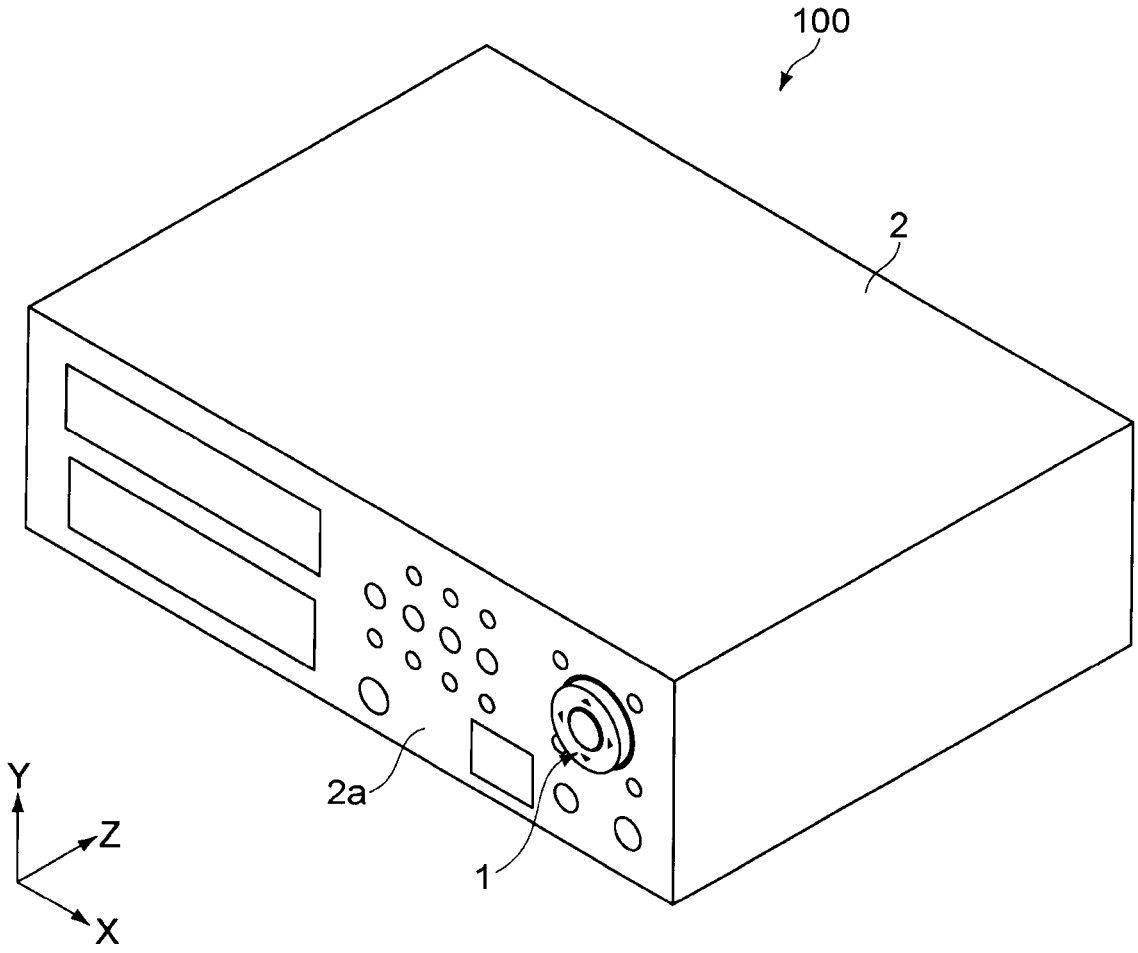
FIG. 1 is an outline view showing an audio device equipped with an arrow key according to a first embodiment of the present invention.

FIG. 1 is an outline view of a stationary audio device equipped with an arrow key according to this embodiment. The audio device 100 is connected with a speaker (not shown) and can reproduce a music file recorded on a recording medium such as a CD (compact disc) or an MD (mini disc) through the speaker.

As shown in FIG. 1, the audio device 100 includes a casing 2. The casing 2 is provided with an arrow key 1 on a front surface 2*a* thereof. With the arrow key 1, for example, a piece of music is selected, reproduced, stopped, fast-forwarded, and rewound. The front surface 2*a* includes various operating portions, a disc tray (disc slot), a display, or the like in addition to the arrow key 1. The description of those constituents is omitted.

Figure 2:
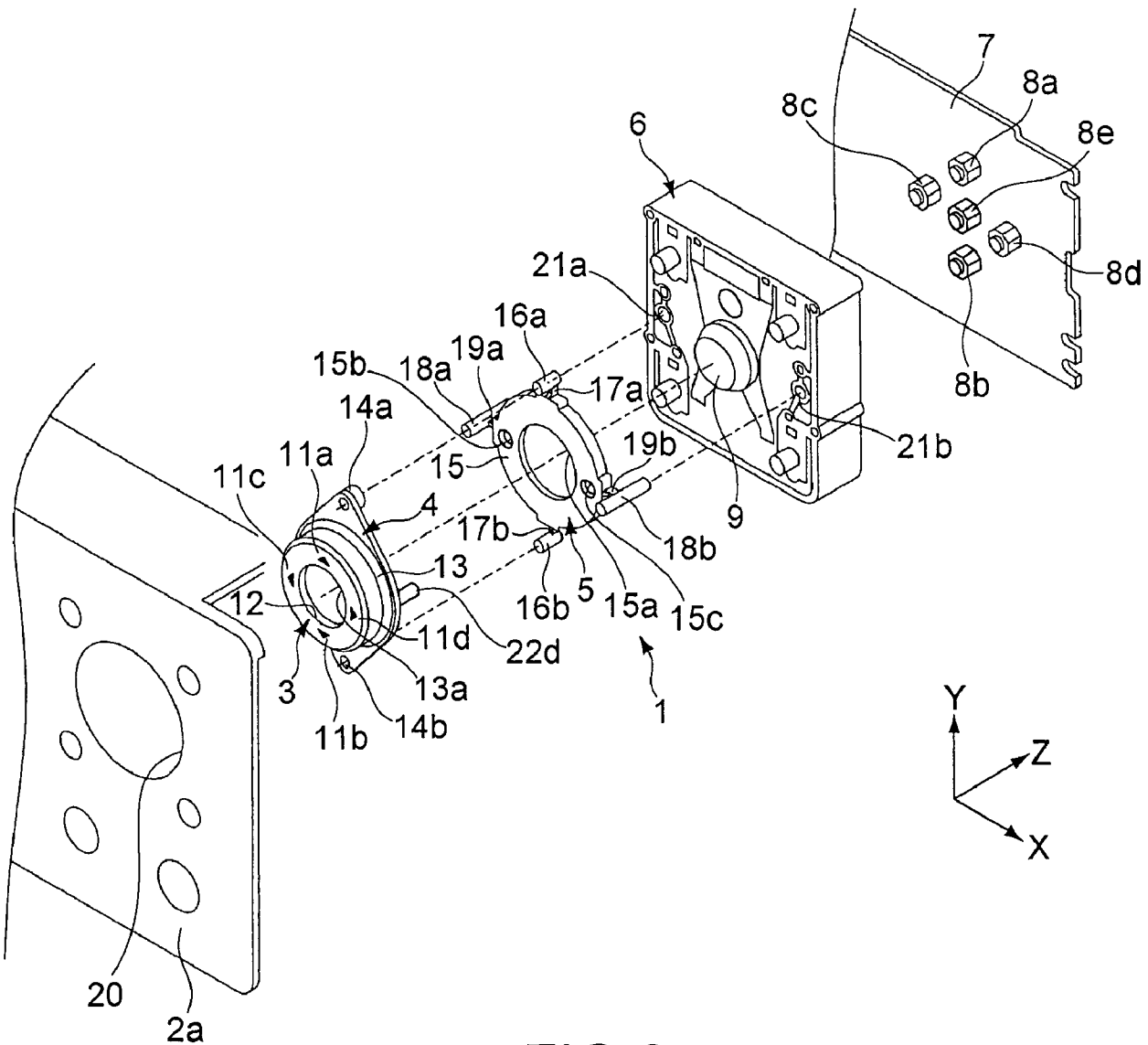
FIG. 2 is an exploded perspective view of the arrow key according to the first embodiment of the present invention.
Figure 3:
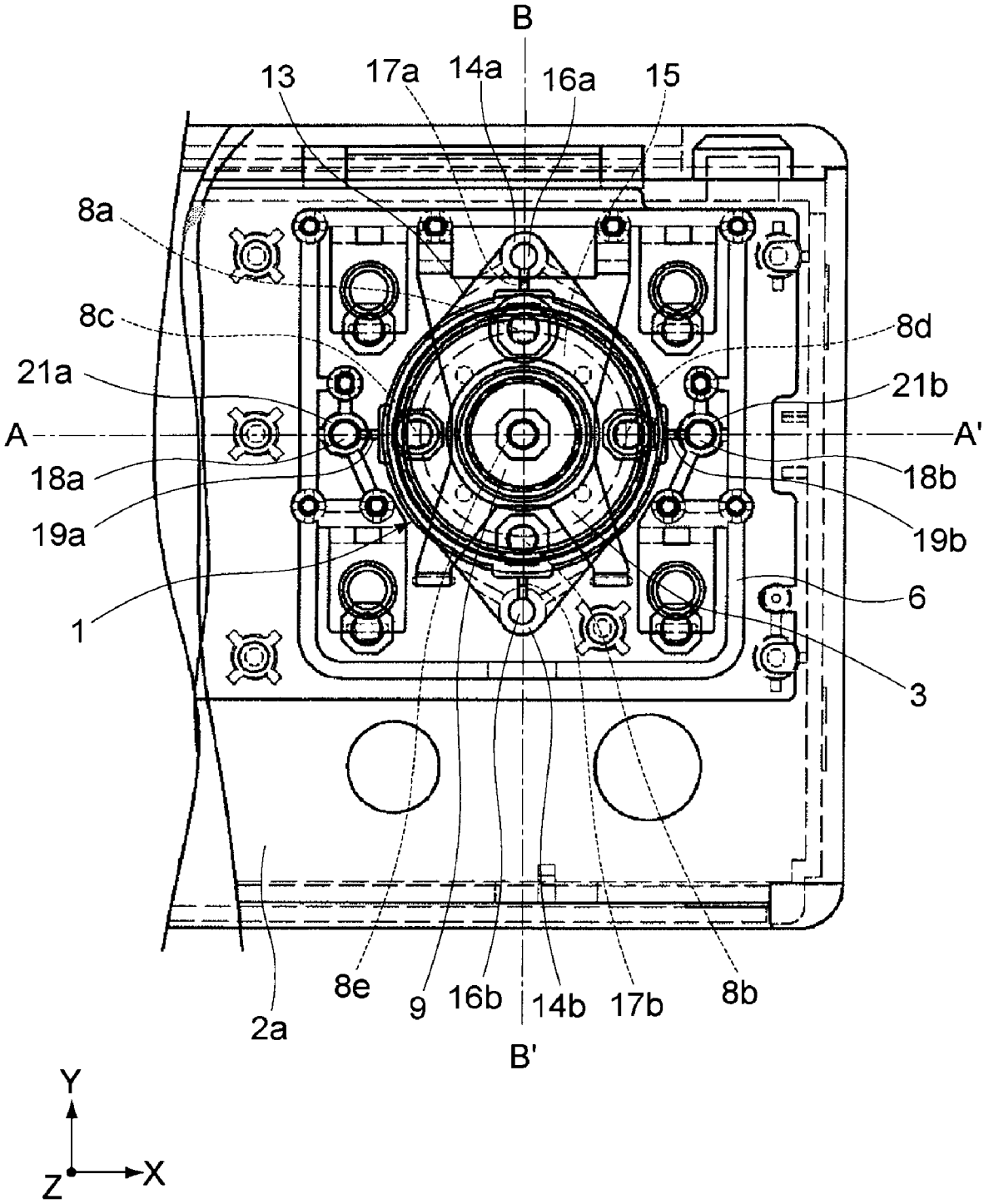
FIG. 3 is a plan view viewed from a front side of the arrow key according to the first embodiment of the present invention.
Figure 4:
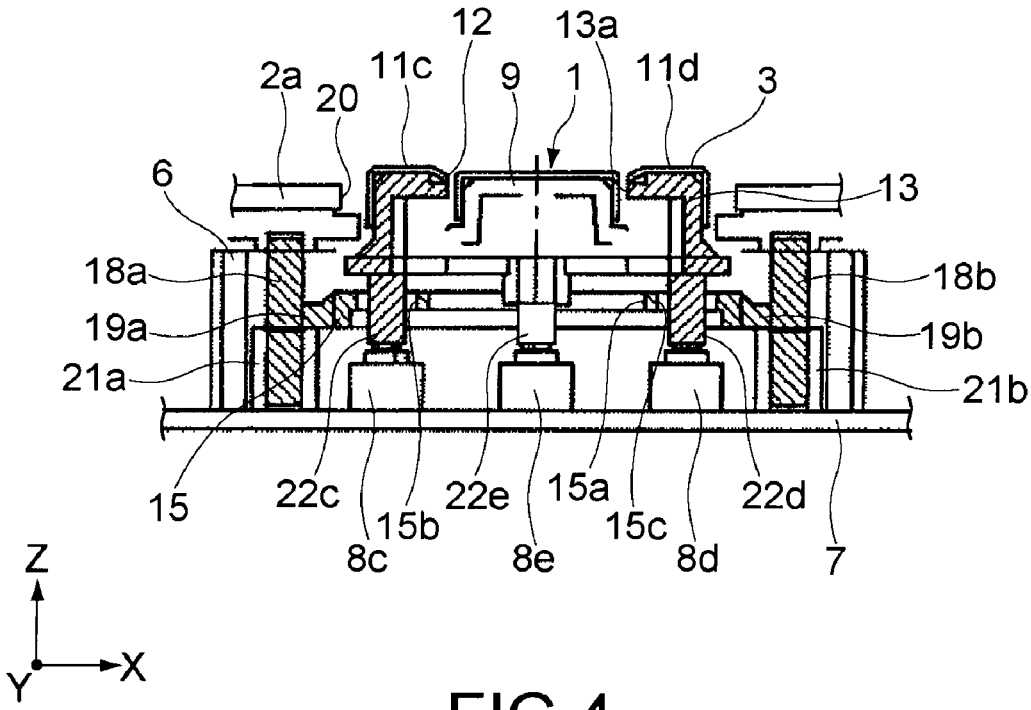
FIG. 4 is a schematic sectional view of the arrow key taken along the line of A-A' of FIG. 3.
Figure 5:
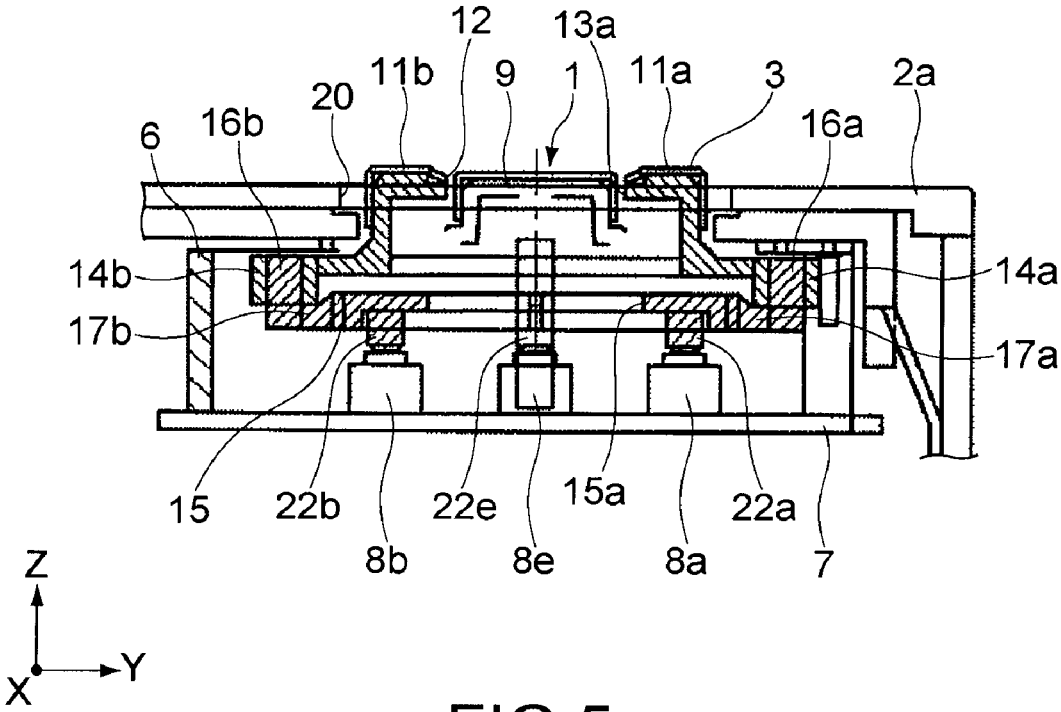
FIG. 5 is a schematic sectional view of the arrow key taken along the line of B-B' of FIG. 3.

FIG. 2 is an exploded perspective view of the arrow key 1 according to this embodiment. FIG. 3 is a plan view of the arrow key 1 viewed from the front surface 2*a*side. FIG. 4 is a schematic sectional view of the arrow key 1 taken along the line A-A' of FIG. 3. FIG. 5 is a schematic sectional view of the arrow key 1 taken along the line B-B' of FIG. 3.

As shown in those drawings, the arrow key 1 is constituted of a key top 3, a first tilting member 4, and a second tilting member 5. The key top 3, the first tilting member 4, and the second tilting member 5 are connected in a Z direction shown in the drawings and are made of a resin. As shown in FIG. 2, the arrow key 1 is supported by a supporting member 6 and connected with a substrate 7.

The key top 3 has a cylindrical shape. The key top 3 includes a first pressing portion 11*a*, a second pressing portion 11*b*, a third pressing portion 11*c*, and a fourth pressing portion 11*d* on a surface thereof. The first to fourth pressing portions 11*a* to 11*d* serve as an up key, a down key, a left key, and a right key, respectively. On the surface of the key top 3, the first pressing portion 11*a* and the second pressing portion 11*b*are disposed on an axis in a Y direction shown in the drawings, while the third pressing portion 11*c* and the fourth pressing portion 11*d* are disposed on an axis in an X direction shown in the drawings. At the center of the key top 3, an opening 12 is provided to cause a decision key 9 to pass therethrough in a Z direction to be exposed from the surface. The decision key 9 is provided to the supporting member 6. Note that on each pressing portions 11*a* to 11*d*, a symbol such as an arrow indicating a point to be pressed or a character is die-stamped or printed. As shown in FIG. 2, the front surface 2*a* of the casing 2 includes an opening 20 configured to cause the key top 3 to pass therethrough to expose the pressing portions 11*a*to 11*d* from the front surface 2*a*.

The first tilting member 4 includes a base portion 13 to which the key top 3 is connected. At both ends of the base portion 13 in the Y direction, the base portion 13 includes bosses 14*a* and 14*b* protruding in the Z direction. The bosses 14*a* and 14*b* each have a hole penetrating in the Z direction. Further, as shown in FIGS. 2, 4, and 5, the base portion 13 includes an opening 13*a* communicated with the opening 12 of the key top 3.

The second tilting member 5 includes a ring-shaped base portion 15. At both ends of the base portion 15 in the Y direction, column portions 16*a* and 16*b* extending in the Z direction are provided. The column portions 16*a*and 16*b* can engage with the holes of the bosses 14*a* and 14*b* of the first tilting member 4. By engaging the bosses 14*a* and 14*b* with the column portions 16*a* and 16*b*, the first tilting member 4 and the second tilting member 5 are connected. Therefore, the first tilting member 4 is supported by the second tilting member 5 while the bosses 14*a* and 14*b* and the column portions 16*a* and 16*b*function as two supporting points.

In addition, as shown in FIGS. 2, 3, and 5, between the base portion 15 and the column portions 16*a* and 16*b*, extending portions 17*a* and 17*b* extending from the base portion 15 in the Y direction are integrally formed. The extending portions 17*a* and 17*b* each include a main surface which has a rectangular plate shape and is perpendicular to the surface mentioned above. The extending portions 17*a* and 17*b* are flexible. Therefore, in a case where the third pressing portion 11*c* or the fourth pressing portion 11*d* of the key top 3 (pressing operation for the left or right key) is pressed, the pressing force causes the extending portions 17*a* and 17*b*to be twisted with respect to the axis in the Y direction. As a result, the first tilting member 4 can tilt with respect to a neutral position (shown in FIGS. 3 to 5) with the bosses 14*a* and 14*b* and the column portions 16*a* and 16*b* being supporting points.

When twisted due to tilt of the first tilting member 4, the extending portions 17*a* and 17*b* can accumulate the twisting force as a return spring force for returning the first tilting member 4 to the neutral position.

Further, as shown in FIGS. 2, 4, and 5, the base portion 15 has an opening 15*a* communicating with the opening 12 of the key top 3 and the opening 13*a* of the first tilting member 4.

As shown in FIGS. 2 to 4, at both ends of the base portion 15 in the X direction, extending portions 19*a* and 19*b* extending in the X direction, which are similar to the extending portions 17*a* and 17*b*, and column portions 18*a* and 18*b* extending in the Z direction are integrally formed. Further, the supporting member 6 includes engaging portions 21*a* and 21*b*. The engaging portions 21*a*and 21*b* have engaging holes capable of engaging with the column portions 18*a* and 18*b*, respectively. By engaging the column portions 18*a* and 18*b* with the engaging portions 21*a* and 21*b*, the second tilting member 5 and the supporting member 6 are connected, and therefore the second tilting member 5 is supported by the supporting member 6 with the column portions 18*a* and 18*b* being two supporting points.

The extending portions 19*a* and 19*b* have flexibility like the extending portions 17*a* and 17*b*. In a case where the first pressing portion 11*a* or the second pressing portion 11*b* of the key top 3 is pressed (up or down key is pressed), the pressing force causes the extending portions 19*a* and 19*b* to be twisted with respect to the axis in the X direction. As a result, the second tilting member 5 can tilt from the neutral position with the column portions 18*a* and 18*b* being supporting points.

When twisted due to the tilt of the second tilting member 5, the extending portions 19*a* and 19*b* can accumulate the twisting force as a return spring force to return the second tilting member 5 to the neutral position, like the extending portions 17*a* and 17*b*.

As shown in FIGS. 2 and 4, at positions on the rear surface of the first tilting member 4 which correspond to the third pressing portion 11*c* and the fourth pressing portion 11*d*, columnar switch pressing portions 22*c* and 22*d* extending in the Z direction are provided. As shown in FIGS. 2 and 5, at positions on the rear surface of the second tilting member 5 which correspond to the first pressing portion 11*a* and the second pressing portion 11*b*, columnar switch pressing portions 22*a* and 22*b* extending in the Z direction are provided, like the switch pressing portions 22*c* and 22*d*. Note that the base portion 15 of the second tilting member 5 includes openings 15*b* and 15*c*for causing the switch pressing portions 22*c* and 22*d* of the first tilting member 4 to pass therethrough.

On the other hand, as shown in FIGS. 2 to 5, the substrate 7 includes switches 8*a* to 8*d* corresponding to the switch pressing portions 22*a* to 22*d*. Further, the substrate 7 is connected to a circuit board of CPU (central processing unit) (not shown) or the like in the audio device 100. When the first tilting member 4 and the second tilting member 5 are tilted, the switch pressing portions 22*a* to 22*d* are caused to press the switches 8*a* to 8*d*. As a result, various kinds of signals depending on the pressing operations are inputted to the CPU to thereby perform processes (e.g., music reproduction/stop, fast-forwarding/rewinding, or changing selection items on the display) corresponding to the various signals.

As described above, the supporting member 6 includes the cylindrical decision key 9 protruding in the Z direction. The decision key 9 passes through the opening 12 of the key top 3, the opening 13*a* of the first tilting member 4, and the opening 15*a* of the second tilting member 5 to be exposed from the surface of the key top 3 so as to be surrounded by the pressing portions 11*a* to 11*d*. The decision key 9 functions as a fifth pressing portion. Further, as shown in FIGS. 4 and 5, in the decision key 9, a switch pressing portion 22*e* extending in the Z direction like the switch pressing portions 22*a*to 22*d* is provided. The substrate 7 includes a switch 8*e*so as to be surrounded by the switches 8*a* to 8*d*. By pressing the decision key 9 to press the switch 8*e*, for example, a selection item is decided by the CPU.

Next, operations of the arrow key 1 structured as described above will be explained. FIG. 6 is a view showing an operation of the arrow key 1 viewed in the Y direction when the third pressing portion 11*c* or the fourth pressing portion 11*d* is pressed (left or right arrow key is pressed). FIG. 7 is a view showing an operation of the arrow key 1 viewed in the X direction when the first pressing portion 11*a* or the second pressing portion 11*b* is pressed (up or down arrow key is pressed).

Figure 6A:
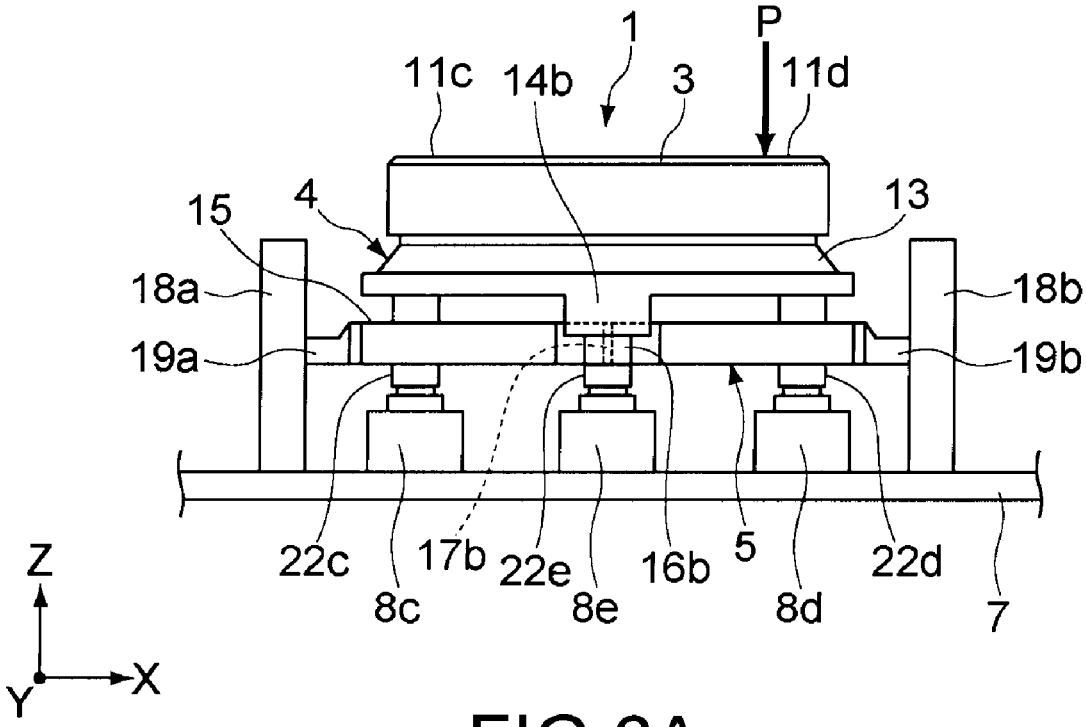
FIG. 6 is a view showing an operation of the arrow key when a third pressing portion or a fourth pressing portion is pressed (left or right arrow key is pressed) in the first embodiment of the present invention.
Figure 6B:
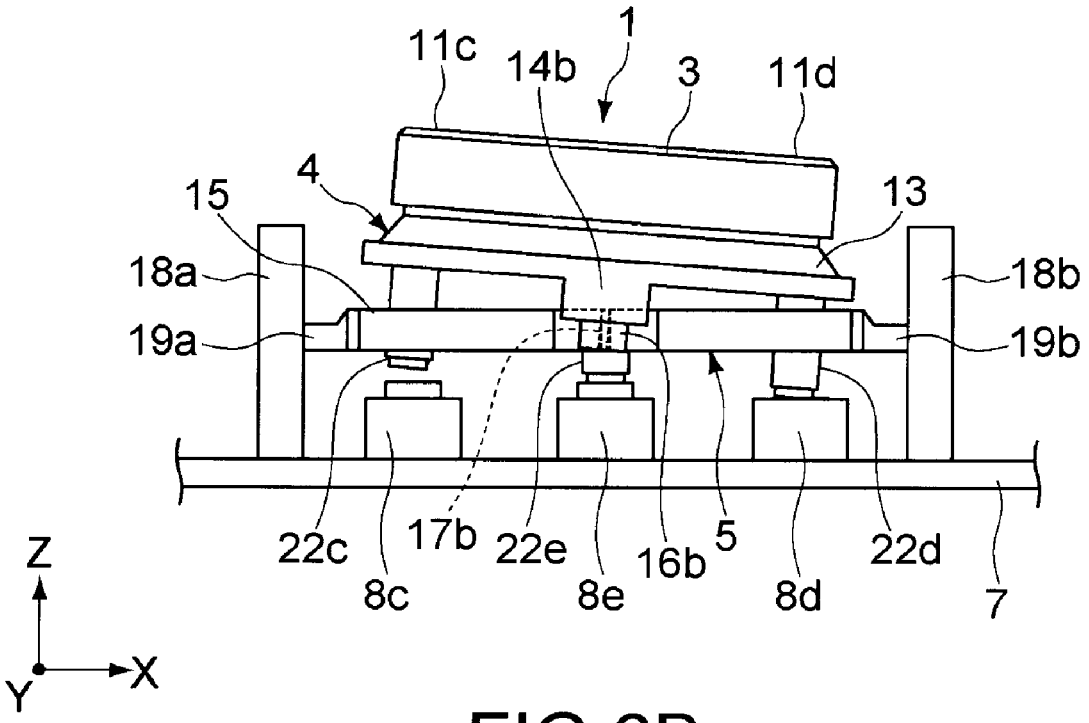

In a neutral position shown in FIG. 6A, when a user presses, for example, the fourth pressing portion 11*d* of the key top 3 in the arrow P direction of FIG. 6A, the extending portions 17*a* and 17*b* of the second tilting member 5 are twisted with respect to the axis in the Y direction, as shown in FIG. 6B. As a result, the first tilting member 4 is tilted with the bosses 14*a* and 14*b* of the first tilting member 4 and the column members 16*a* and 16*b* of the second tilting member 5 being supporting points. Along with the tilt of the first tilting member 4, the switch pressing portion 22*d* is pressed to press the switch 8*d*, to thereby input an operation signal corresponding to the pressing operation.

Further, the extending portions 17*a* and 17*b*accumulate the twisting force caused by the tilt as a return spring force. Therefore, when the pressing operation is released (when the user takes the finger off the fourth pressing portion 11*d*), the first tilting member 4 returns to the neutral position shown in FIG. 6A due to the return spring force.

It should be noted that when the third pressing portion 11*c* is pressed (not shown), the first tilting member 4 tilts in a direction opposite to the tilting direction shown in FIG. 6B with the bosses 14*a* and 14*b* of the first tilting member 4 and the column portions 16*a*and 16*b* of the second tilting member 5 being the supporting points. When the pressing operation is released, the first tilting member 4 returns to the neutral position shown in FIG. 6A due to the return spring force accumulated in the extending portions 17*a*and 17*b*.

Figure 7A:
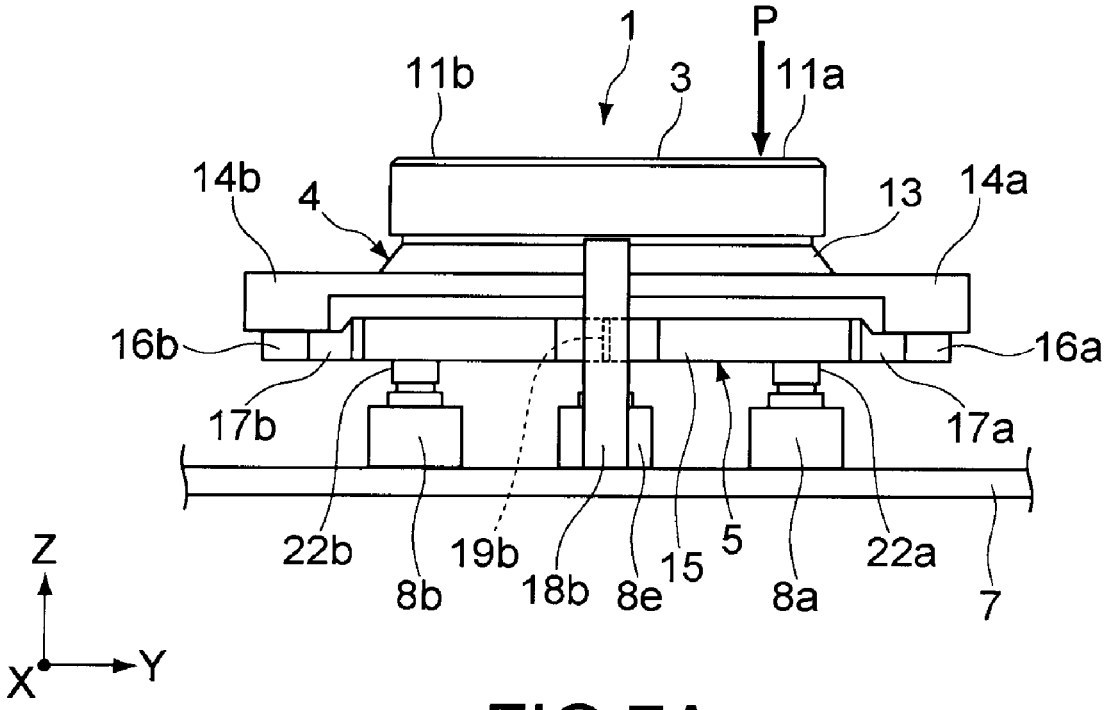
FIG. 7 is a view showing an operation of the arrow key when a first pressing portion or a second pressing portion is pressed (up or down arrow key is pressed) in the first embodiment of the present invention.
Figure 7B:
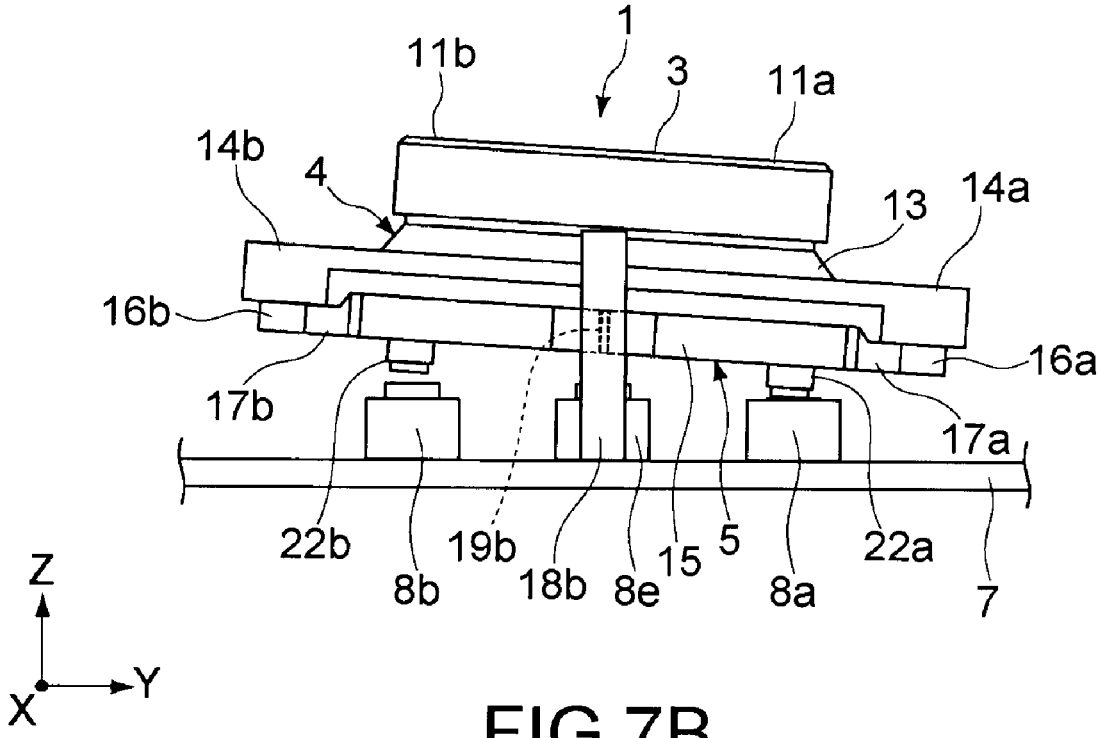

On the other hand, in a neutral position shown in FIG. 7A, when a user presses, for example, the first pressing portion 11*a* of the key top 3 in the arrow P direction of FIG. 7A, the extending portions 19*a* and 19*b*of the second tilting member 5 are twisted with respect to the axis in the X direction, as shown in FIG. 7B. As a result, the second tilting member 5 and the first tilting member 4 are tilted, with the column members 18*a*and 18*b* being supporting points. Along with the tilt of the second tilting member 5 and the first tilting member 4, the switch pressing portion 22*a* is pressed to press the switch 8*a*, to thereby input an operation signal corresponding to the pressing operation.

Further, the extending portions 19*a* and 19*b*accumulate the twisting force accumulated due to the tilt as a return spring force. Therefore, when the pressing operation is released, the second tilting member 5 returns to the neutral position (shown in FIG. 7A) along with the first tilting member 4 due to the return spring force.

It should be noted that when the second pressing portion 11*b* is pressed (not shown), the second tilting member 5 is tilted in a direction opposite to the tilting direction of FIG. 7B, with the column portions 18*a* and 18*b* being supporting points. When the pressing operation is released, the second tilting member 5 returns to the neutral position of FIG. 7A with the use of the return spring force accumulated in the extending portions 19*a*and 19*b*.

As described above, according to this embodiment, among the four pressing portions of the key top 3, when the third pressing portion 11*c* or the fourth pressing portion 11*d* is pressed, the first tilting member 4 is tilted with the two points on the axis in the Y direction being the supporting points. Meanwhile, when the first pressing portion 11*a* or the second pressing portion 11*b*is pressed, the second tilting member 5 is tilted with the two points on the axis in the X direction being the supporting points. In other words, the tilting members are tilted in response to the pressing operations while being stably supported by the two supporting points, respectively. Thus, variations in the tilting angle and the tilting stroke in response to the pressing operation are not caused, which can remarkably enhance the operability when the pressing operation is performed.

In addition, the first tilting member 4 and the second tilting member 5 return to the neutral position by using the return spring force accumulated in the extending portions 17*a* and 17*b* and the extending portions 19*a* and 19*b* which are formed integrally with the second tilting member 5. Therefore, stable, comfortable pressing operability (tactile feedback when the pressing operation is performed) for a user can be obtained without additionally providing parts, unlike a case in which a buffering member for return, such as a coil spring or a cushion, is additionally provided. Thus, it is possible to suppress variations caused during manufacturing and to enhance a yield.

Further, the arrow key 1 includes tilt supporting points at respective both ends of the first tilting member 4 and the second tilting member 5. Therefore, unlike a case in which an arrow key is tilted with respect to one supporting point in the Z direction located at the center of the key top in related art, an available space can be provided at the center thereof. Thus, another pressing portion such as the decision key 9 can be easily provided using the space without interfering with any other members.

Second Embodiment

Next, a second embodiment of the present invention will be described. In this embodiment, a description of the same structure and function as the first embodiment will be simplified or omitted.

Figure 8:
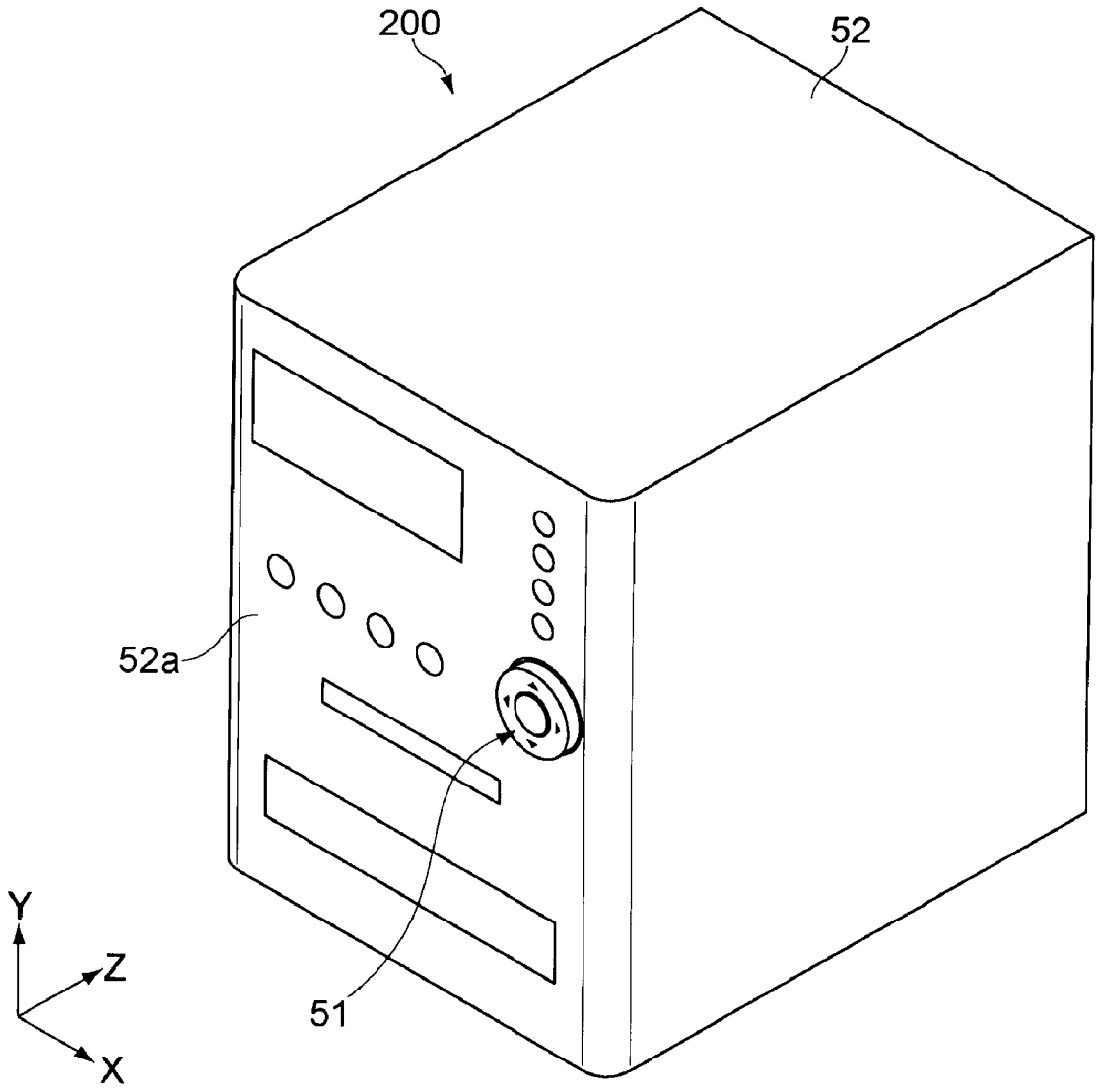
FIG. 8 is an outline view of an audio device equipped with an arrow key according to a second embodiment of the present invention.

FIG. 8 is an outline view of an audio device 200 equipped with an arrow key according to this embodiment. Like the audio device 100 of the first embodiment, the audio device 200 can reproduce a music file recorded on a recording medium such as a CD or an MD through a speaker (not shown). In addition, the audio device 200 includes an HDD (hard disk drive) incorporated therein and can reproduce a music file recorded in the HDD.

As shown in FIG. 8, the audio device 200 includes a casing 52. On a front surface 52*a* of the casing 52, an arrow key 51 is provided. Like the arrow key 1 of the first embodiment, the arrow key 51 is used for, for example, selecting a piece of music or performing reproduction, stop, fast-forwarding, rewinding, or the like. Note that the front surface 52*a* includes various kinds of operating portions, a disc tray (disc slot), and a display in addition to the arrow key 51. But a description of those constituents is omitted.

Figure 9:
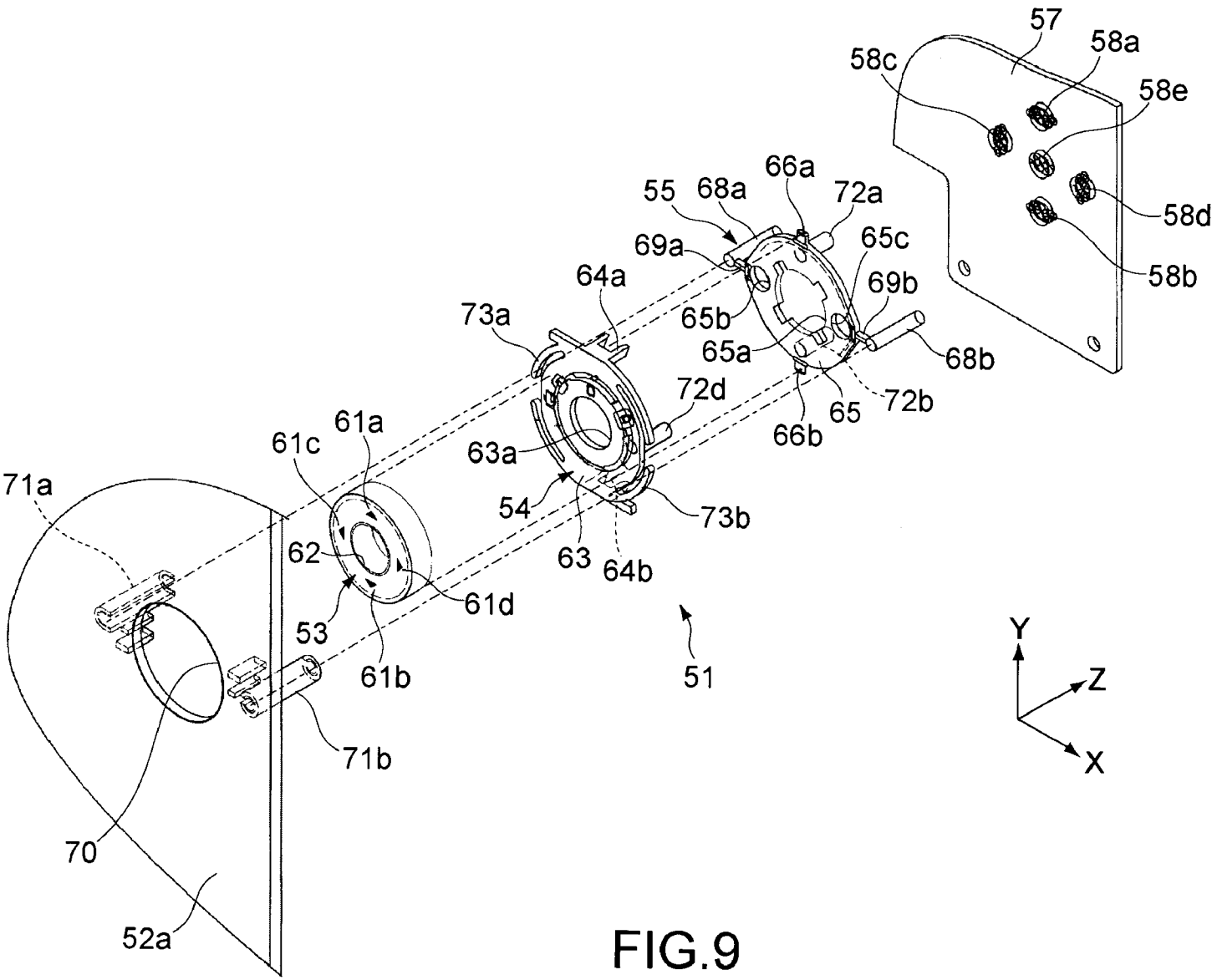
FIG. 9 is an exploded perspective view of the arrow key according to the second embodiment of the present invention.
Figure 10:
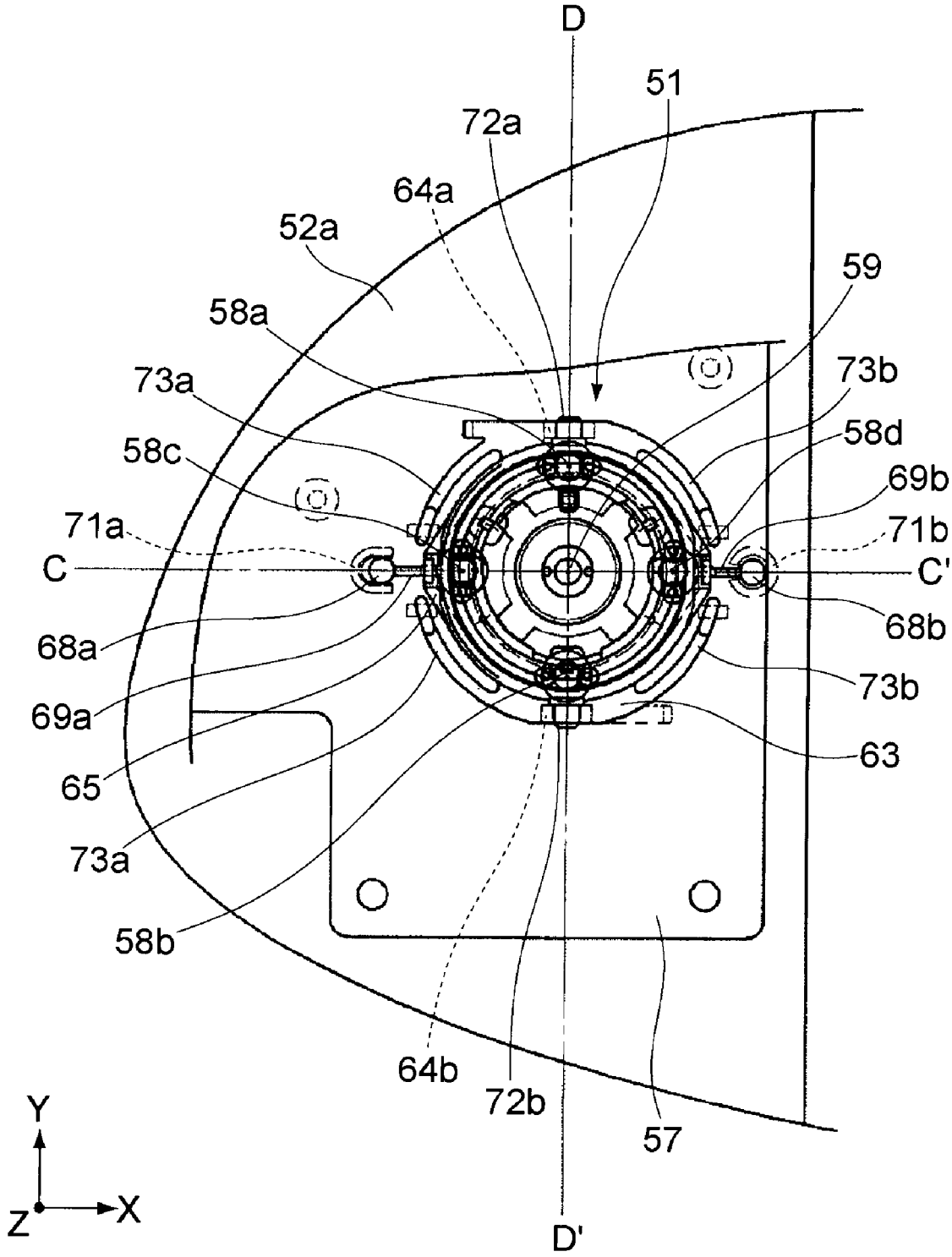
FIG. 10 is a plan view viewed from a front side of the arrow key according to the second embodiment of the present invention.
Figure 11:
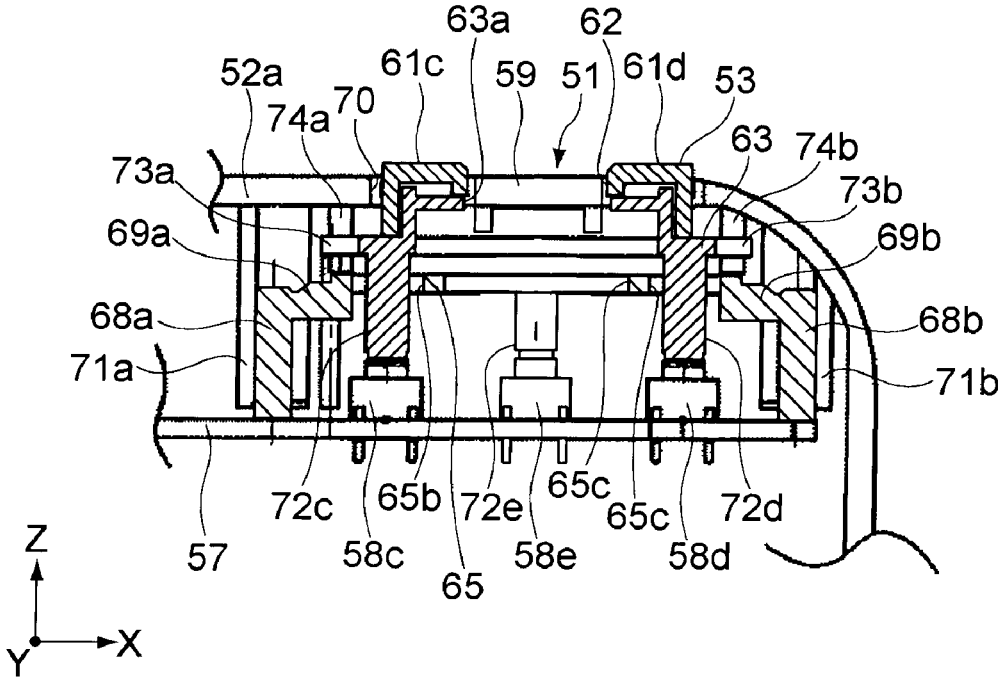
FIG. 11 is a schematic sectional view of the arrow key taken along the line C-C' of FIG. 10.
Figure 12:
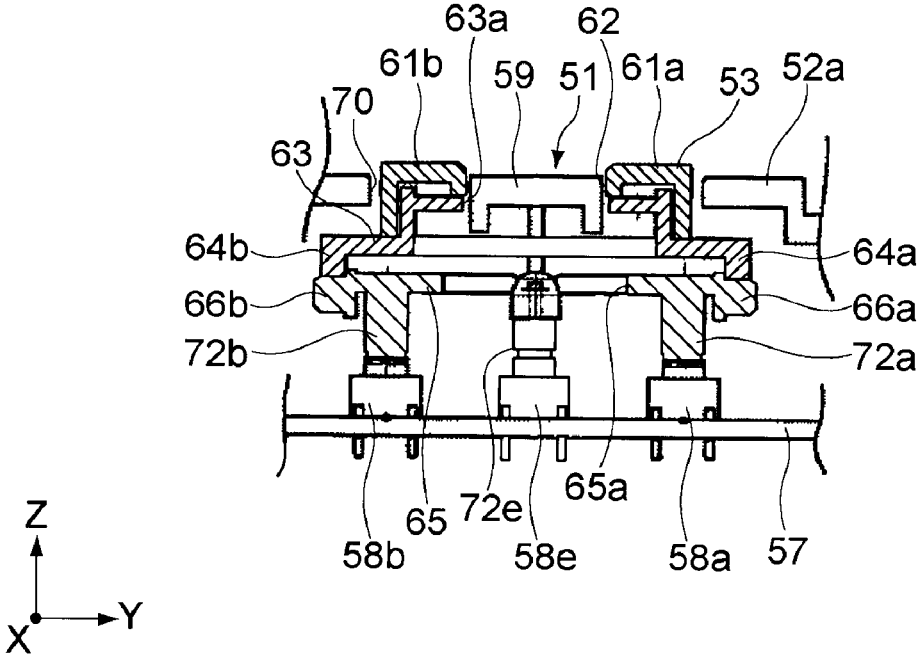
FIG. 12 is a schematic sectional view of the arrow key taken along the line D-D' of FIG. 10.

FIG. 9 is an exploded perspective view of the arrow key 51 according to this embodiment. FIG. 10 is a plan view viewed from a front surface 52*a* side of the arrow key 51. FIG. 11 is a schematic sectional view of the arrow key 51 taken along the line C-C' of FIG. 10. FIG. 12 is a schematic sectional view of the arrow key 51 taken along the line D-D' of FIG. 10.

As shown in those drawings, like the arrow key 1 of the first embodiment, the arrow key 51 includes a key top 53, a first tilting member 54, and a second tilting member 55. The key top 53, the first tilting member 54, and the second tilting member 55 are connected with each other in a Z direction of those drawings. Further, the arrow key 51 is connected to a substrate 57. The substrate 57 includes five switches 58*a* to 58*e*, like the substrate 7 of the first embodiment.

Basic structures of the key top 53, the first tilting member 54, and the second tilting member 55 are almost the same as those of the key top 3, the first tilting member 4, and the second tilting member 5 of the first embodiment. However, this embodiment is different from the first embodiment in that the first tilting member 54 and the second tilting member 55 are connected using a hinge mechanism instead of the bosses and the column portions.

Specifically, as shown in FIGS. 9, 10, and 12, at both ends of a base portion 65 of the second tilting member 55 in a Y direction of the drawings, rotating shafts 66*a* and 66*b* are integrally formed so as to protrude in the Y direction. Meanwhile, at both ends of a base portion 63 of the first tilting member 54 in the Y direction, engaging portions 64*a* and 64*b* are integrally formed. The engaging portions 64*a* and 64*b* can engage with the rotating shafts 66*a* and 66*b*, respectively. The rotating shafts 66*a* and 66*b* and the engaging portions 64*a*and 64*b* are engaged with each other to thereby constitute the hinge mechanism. As a result, the first tilting member 54 and the second tilting member 55 are connected with each other, and the first tilting member 54 can rotate to tilt with the rotating shafts 66*a* and 66*b* being the supporting points.

Incidentally, because the hinge mechanism is provided, the second tilting member 55 does not have a return spring force at the supporting points thereof, unlike the extending portions 17*a* and 17*b* of the first embodiment. In view of this, in this embodiment, the base portion 63 of the first tilting member 54 includes biasing portions 73*a* and 73*b* serving as two arm-shaped cantilever springs as shown in FIGS. 9 to 11. The biasing portions 73*a* and 73*b* respectively and circumferentially extend from near both ends of the base portion 63 in the Y direction toward both ends thereof in an X direction. As shown in FIG. 11, the biasing portions 73*a* and 73*b* are come into contact with convex portions 74*a* and 74*b* formed so as to protrude from the inner side of the front surface 52*a* of the casing 52 in the Z direction. The operation of the biasing portions 73*a* and 73*b* will be described later.

Further, in the first embodiment, the arrow key 1 is supported by the supporting member 6. On the other hand, in this embodiment, the arrow key 51 is supported by the front surface 52*a* of the casing 52.

Specifically, as shown in FIGS. 9 to 11, on the inner side of the front surface 52*a* of the casing 52, cylindrical engaging portions 71*a* and 71*b* are provided. The engaging portions 71*a* and 71*b* can engage with column portions 68*a* and 68*b* provided to the base portion 65 of the second tilting member 55. When the column portions 68*a* and 68*b* engage with the engaging portions 71*a* and 71*b*, respectively, the arrow key 51 is supported by the front surface 52*a*.

The other structures and functions of the arrow key 51 are the same as those of the arrow key 1 of the first embodiment. That is, the second tilting member 55 includes extending portions 69*a* and 69*b* which are integrally formed with the column portions 68*a* and 68*b* at both ends of the base portion 65 in the X direction. When a first pressing portion 61*a* or a second pressing portion 61*b* is pressed, the extending portions 69*a* and 69*b* are twisted with respect to an axis in the X direction, thereby tilting the second tilting member 55. Then, the second tilting member 55 can return to a neutral position by a return spring force accumulated in the extending portions 69*a* and 69*b*. As shown in FIGS. 10 to 12, at the center of the arrow key 51, a decision key 59 functioning as a fifth pressing portion is provided (not shown in FIG. 9).

Next, the operation of the arrow key 51 structured as described above is described. FIG. 13 is a view showing an operation of the arrow key 51 viewed in the Y direction when a third pressing portion 61*c* or a fourth pressing portion 61*d* is pressed (left or right arrow key is pressed). FIG. 14 is a view showing an operation of the arrow key 51 viewed in the X direction when the first pressing portion 61*a* or the second pressing portion 61*b*is pressed (up or down arrow key is pressed).

Figure 13A:
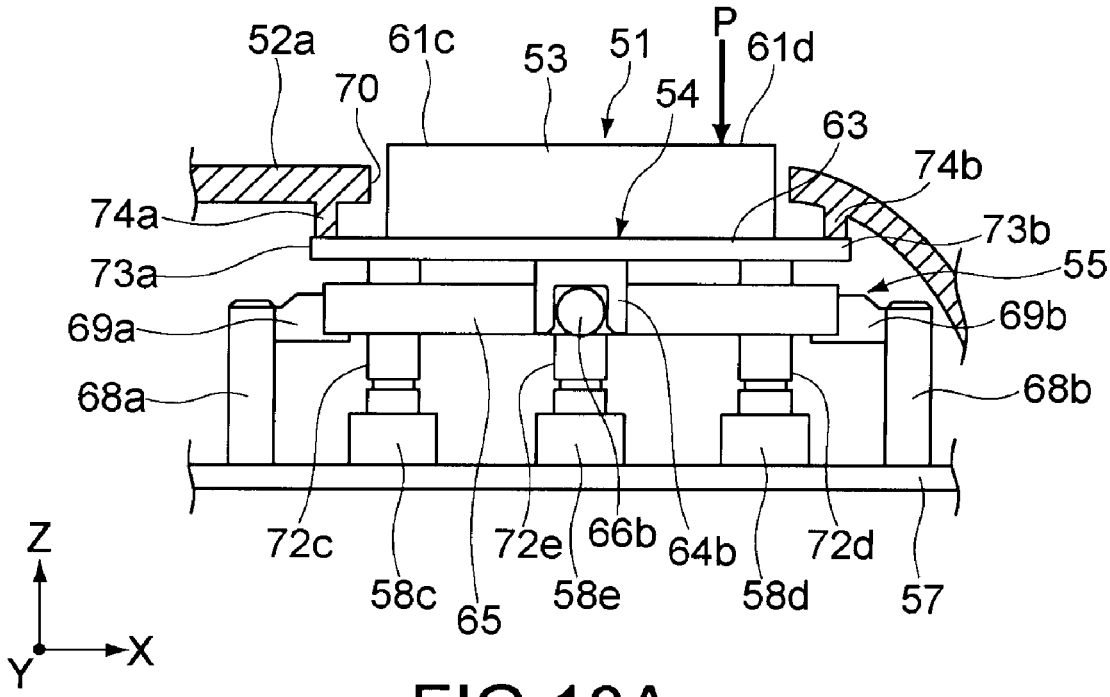
FIG. 13 is a view showing an operation of the arrow key when a third pressing portion or a fourth pressing portion is pressed (left or right arrow key is pressed) in the second embodiment of the present invention.
Figure 13B:
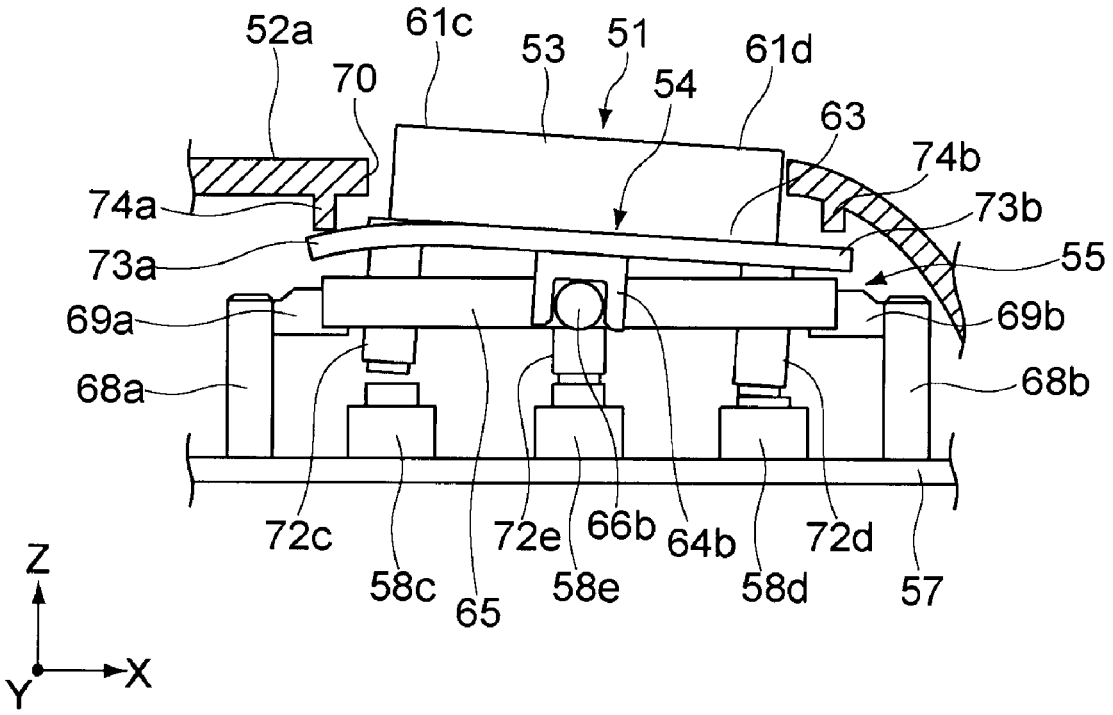

In the neutral position shown in FIG. 13A, when a user presses, for example, the fourth pressing portion 61*d* of the key top 53 in the arrow P direction of FIG. 13A, the first tilting member 54 rotates clockwise in FIG. 13B to be tilted while the engaging portions 64*a* and 64*b* are engaged with the rotating shafts 66*a* and 66*b* of the second tilting member 55, as shown in FIG. 13B. Along with the tilt, the switch 58*d* is pressed by a switch pressing portion 72*d* to thereby input an operation signal corresponding to the pressing operation.

In addition, because of the biasing force, the biasing portion 73*a* of the first tilting member 54 curves against an abutting force of the convex portion 74*a*provided on the inner side of the front surface 52*a*. Therefore, when the pressing operation is released, the first tilting member 54 accumulates the biasing force as a return spring force and returns to the neutral position shown in FIG. 13A by the return spring force.

It should be noted that when the third pressing portion 61*c* is pressed (not shown), the first tilting member 54 tilts by using the rotating shafts 66*a* and 66*b*in a direction opposite to the tilting direction shown in FIG. 13B. When the pressing operation is released, by using, as the return spring force, the biasing force accumulated when the biasing portion 73B curves while being in contact with the convex portion 74*b*, the first tilting member 54 returns to the neutral position shown in FIG. 13A.

Figure 14A:
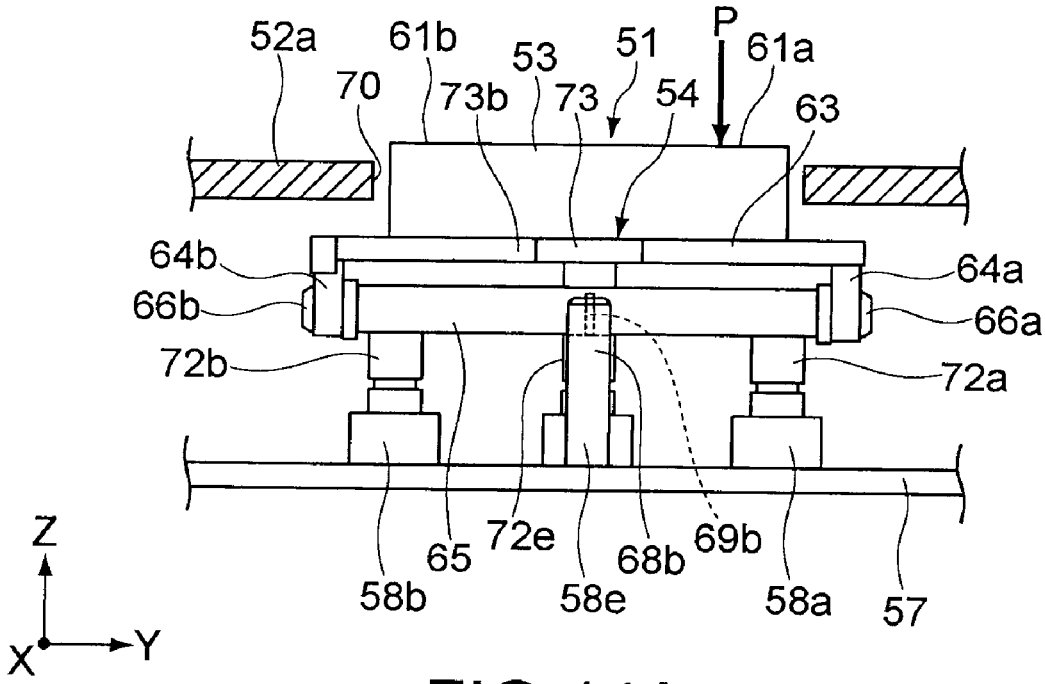
FIG. 14 is a view showing an operation of the arrow key when a first pressing portion or a second pressing portion is pressed (up or down arrow key is pressed) in the second embodiment of the present invention.
Figure 14B:
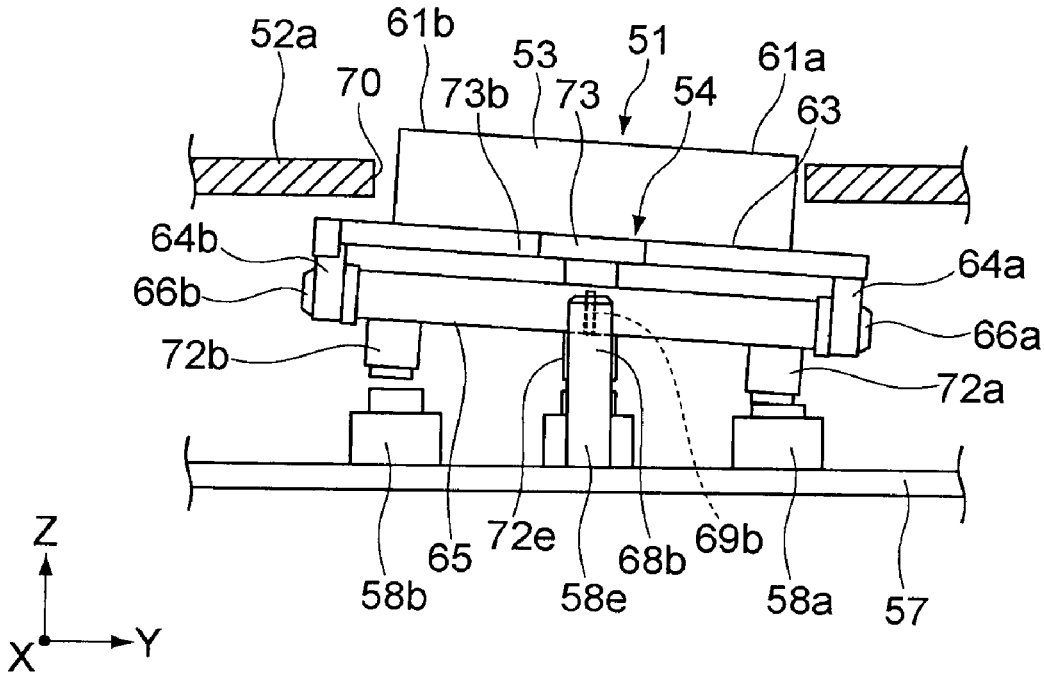

On the other hand, in a neutral position shown in FIG. 14A, when a user presses for example the first pressing portion 61*a* of the key top 53 in the arrow P direction of FIG. 14A, the extending portions 69*a* and 69*b*of the second tilting member 55 are twisted with respect to the axis in the X direction as shown in FIG. 14B. Then, along with the first tilting member 54, the second tilting member 55 is tilted with the column portions 68*a*and 68*b* being supporting points. Along with the tilt, the switch pressing portion 72*a* is caused to press the switch 58*a*, to thereby input an operation signal corresponding to the pressing operation.

Further, the extending portions 69*a* and 69*b*accumulate the twisting force caused by the tilt as the return spring force. Therefore, when the pressing operation is released, the return spring force causes the second tilting member 55 to return to the neutral position shown in FIG. 14A along with the first tilting member 54.

It should be noted that when the second pressing portion 61*b* is pressed (not shown), the second tilting member 55 tilts in a direction opposite to the tilting direction shown in FIG. 14B with the column portions 68*a*and 68*b* being supporting points. When the pressing operation is released, the second tilting member 55 returns to the neutral position shown in FIG. 14A by using the return spring force accumulated in the extending portions 69*a* and 69*b*.

As described above, according to this embodiment, the tilting members can be tilted while being stably supported by the two supporting points, respectively. Thus, variations in tilting angle and tilting stroke for the pressing operations can be eliminated. As a result, the operability for the pressing operation can be remarkably enhanced.

The first tilting member 54 is rotated and tilted through the hinge mechanism. Therefore, the arrow key 51 can be downsized in the Y direction as compared with the arrow key of the first embodiment. Thus, in the Y direction, the casing 52 can have a space in which a part other than the arrow key 51 is provided. As a result, even in the casing having only a limited space in which a part is provided, the arrow key capable of providing excellent operability can be equipped.

Further, even when the first tilting member 54 is rotated through the hinge mechanism, by using the biasing portions 73*a* and 73*b*, the return spring force against the pressing force can be obtained without additionally providing parts.

The present invention is not limited to the embodiments described above. The present invention can of course be adapted to various changes without departing from the gist of the present invention.

In the first embodiment described above, the first tilting member 4 and the second tilting member 5 are connected with each other by using the bosses 14*a* and 14*b*of the first tilting member 4 and the column portions 16*a*and 16*b* and the extending portions 17*a* and 17*b* of the second tilting member 5. Conversely, the column portions and extending portions may be provided to the first tilting member 4, while the bosses may be provided to the second tilting member 5. As a result, the first tilting member 4 and the second tilting member 5 are connected with each other to tilt the first tilting member 4.

The arrow key 1 of the first embodiment is supported by the supporting member 6. As in the case of the arrow key 51 of the second embodiment, the arrow key 1 may be directly supported by the casing. Conversely, the arrow key 51 of the second embodiment may be supported by another supporting member instead of the casing 52, as in the case of the arrow key 1 of the first embodiment.

In the embodiments described above, the column portions and extending portions or the hinge mechanism causes the tilting members to tilt. Any other mechanism may be used to tilt the tilting members as long as other tilting members, which respectively correspond to the first and second pressing portions (up and down key) and the third and fourth pressing portions (right and left key), are additionally provided and tilted while being supported by two supporting points, respectively.

In the embodiments described above, the first tilting member corresponds to the right and left key and the second tilting member corresponds to the up and down key. Of course, the first tilting member may correspond to the up and down key and the second tilting member may correspond to the right and left arrow key.

In the embodiments described above, the arrow key is provided to the audio device. The arrow key according to the present invention can be provided to any electronic device involving an operating portion, for example, AV equipment other than the audio device (e.g., a television set), a game machine (including a controller for the game machine), a PC, a car navigation system, or a remote control for various electronic devices.

What is claimed is:

1. A multidirectional input apparatus, comprising:

a pressing operation member including a surface, a first pressing portion and a second pressing portion which are provided on a first axis on the surface, and a third pressing portion and a fourth pressing portion which are provided on a second axis which passes between the first pressing portion and the second pressing portion and is perpendicular to the first axis on the surface;

a first tilting member which is connected to the pressing operation member on a pressing direction side and is capable of tilting from a first neutral position by a pressing force to the third pressing portion and the fourth pressing portion with two points on a third axis in parallel to the first axis being a first supporting point and a second supporting point, respectively; and a second tilting member which is connected to the first tilting member on the pressing direction side and is capable of tilting from a second neutral position by a pressing force to the first pressing portion and the second pressing portion with two points on a fourth axis in parallel to the second axis being a third supporting point and a fourth supporting point, respectively.

2. The multidirectional input apparatus as set forth in claim 1, further comprising:

a supporting member supporting the second tilting member, wherein the first tilting member includes a first base portion connected to the pressing operation member, and a first connection portion and a second connection portion which are integrally provided on both ends of the first base portion on the third axis and connected to the second tilting member so as to be the first supporting point and the second supporting point, respectively, and wherein the second tilting member includes a second base portion including a third connection portion and a fourth connection portion which are connected to the first connection portion and the second connection portion, respectively, on an axis perpendicular to the fourth axis, and a fifth connection portion and a sixth connection portion which are integrally provided on both ends of the second base portion on the fourth axis and connected to the supporting member so as to be the third supporting point and the fourth supporting point, respectively.

3. The multidirectional input apparatus as set forth in claim 2, wherein the first tilting member has a first return spring force to return to the first neutral position against the pressing force to the third pressing portion and the fourth pressing portion, and wherein the second tilting member has a second return spring force to return to the second neutral position against the pressing force to the first pressing portion and the second pressing portion.

4. The multidirectional input apparatus as set forth in claim 3, wherein one of a set of the first and second connection portions and a set of the third and fourth connection portions is made of a flexible material capable of using a first twisting force accumulated due to the pressing force to the third pressing portion and the fourth pressing portion as the first return spring force, and wherein the fifth and sixth connection portion is made of a flexible material capable of using a second twisting force accumulated due to the pressing force to the first pressing portion and the second pressing portion as the second return spring force.

5. The multidirectional input apparatus as set forth in claim 3, the multidirectional input apparatus being capable of being provided to an electronic device which includes a casing including a first surface in parallel to the surface, a second surface which is an inner surface of the first surface, and an opening causing the first surface and the second surface to be communicated with each other and causing the pressing operation member to be exposed, wherein the first and third connection portions and the second and fourth connection portions constitute a hinge mechanism capable of tilting the first tilting member by rotation about the third axis, wherein the first base portion is contactable to the second surface along with pressing to the third pressing portion and the fourth pressing portion, and integrally includes a first biasing portion and a second biasing portion capable of using, as the first return spring force, biasing forces against contacting forces when the hinge mechanism is rotated, and wherein the fifth and sixth connection portions are made of a flexible material capable of using a twisting force accumulated due to the pressing force to the first pressing portion and the second pressing portion as the second return spring force.

6. The multidirectional input apparatus as set forth in claim 1, wherein the pressing operation member includes a first opening portion formed at a center of the surface so as to be surrounded by the first to fourth pressing portions, wherein the first tilting member includes a second opening portion formed between the first supporting point and the second supporting point, and wherein the second tilting member includes a third opening portion formed between the third supporting point and the fourth supporting point, the multidirectional input apparatus further comprising a fifth pressing portion provided so as to be exposed from the surface and pass through the first to third opening portions.

7. An electronic device, comprising:

a multidirectional input apparatus including a pressing operation member including a surface, a first pressing portion and a second pressing portion which are provided on a first axis on the surface, and a third pressing portion and a fourth pressing portion which are provided on a second axis which passes between the first pressing portion and the second pressing portion and is perpendicular to the first axis on the surface, a first tilting member which is connected to the pressing operation member on a pressing direction side and is capable of tilting from a first neutral position by a pressing force to the third pressing portion and the fourth pressing portion with two points on a third axis in parallel to the first axis being a first supporting point and a second supporting point, respectively, and a second tilting member which is connected to the first tilting member on the pressing direction side and is capable of tilting from a second neutral position by a pressing force to the first pressing portion and the second pressing portion with two points on a fourth axis in parallel to the second axis being a third supporting point and a fourth supporting point, respectively;

a casing accommodating the multidirectional input apparatus; and first to fourth switches each capable of inputting a predetermined operation signal by a pressing force to the first to fourth pressing portion.

* * * * *